US006201376B1

(12) United States Patent
Mweene et al.

(10) Patent No.: US 6,201,376 B1
(45) Date of Patent: Mar. 13, 2001

(54) APPARATUS AND METHOD FOR ESTABLISHING AN OPERATING PARAMETER FOR A POWER SUPPLY DEVICE

(75) Inventors: Loveday Haachitaba Mweene, Mesquite; Donald David Mondul, Dallas, both of TX (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/493,553

(22) Filed: Jan. 28, 2000

(51) Int. Cl.[7] ..... G05F 1/40
(52) U.S. Cl. ..... 323/284; 323/285; 323/351
(58) Field of Search ..... 363/100; 323/349, 323/350, 351, 318, 284, 285

(56) References Cited

U.S. PATENT DOCUMENTS 4,823,070 * 4/1989 Nelson ..... 323/285

* cited by examiner

*Primary Examiner*—Peter S. Wong
*Assistant Examiner*—Gary L. Laxton

(57) ABSTRACT

An apparatus for establishing an operating parameter for a power supply device having an output includes: (a) a first signal source; (b) a second signal source; (c) a third signal source; and (d) a state device. The first signal source is controllable for generating a programming signal. The second signal source generates a load indicating signal and is connected with the power supply. The third signal source generates an offset signal. The state device has a first input and a second input and changes state when the first input has a predetermined relationship with the second input. The first input is determined by relative values of the programming signal and the offset signal. The second input is related with the output. The power supply device shuts down when the state device changes state. The method includes the steps of: (a) providing, in no particular order, the following signals: (1) a programming signal appropriate for the shutdown circumstance; and (2) an offset signal; (b) applying a signal representative of the output to a first input of a state device; (c) substantially simultaneously with step (b), applying one of the following signals to a second input of the state device: (1) the programming signal; or (2) a combination of the programming signal and the offset signal; and (d) changing state of the state device when the first input has a predetermined relationship with the second input. The shutdown circumstance is effected when the state changes.

9 Claims, 4 Drawing Sheets

APPARATUS AND METHOD FOR ESTABLISHING AN OPERATING PARAMETER FOR A POWER SUPPLY DEVICE

BACKGROUND OF THE INVENTION

The present invention is directed to an apparatus and method for establishing an operating parameter for electrical power supply apparatuses. The present invention is especially directed to an apparatus and method for establishing shutdown output current for DC-to-DC power converter apparatuses. In most contemporary DC-to-DC power converter apparatuses, there is an inherent current limit involved in the operation of the apparatus. That is, beyond a certain point, the power generated by the converter device becomes substantially constant, so as output or load current (I) increases, the output voltage (V) decreases. When this condition is reached, it is frequently desireable for the apparatus to turn off. Turning off is desireable because the low output voltage is not adequate for the load, and the increased output current can harm the DC-to-DC converter. It is desirable for DC-to-DC power converter apparatuses to be flexible in their applicability to various products. Such flexibility allows a manufacturer of such apparatuses to reduce the number of discrete apparatus models that must be offered in order to provide a product line that addresses a wide range of possible applications. One aspect of such desired flexibility is to provide users, or customers, with a capability to control the output current limit for DC-to-DC power converter apparatuses. That is, users of DC-to-DC apparatuses desire that they may set the current limit for the apparatus. Such control has been made available to users of such apparatuses in the past, but there are problems with such earlier offerings, especially at low output current levels.

Earlier solutions to providing customer, or user control of the current limit for DC-to-DC power converter apparatuses involved an estimating methodology that introduced significant error into the turn-off point of the apparatus and risked uncontrolled, and therefore unanticipated shut down of the apparatus. Such earlier solutions introduced an offset to a programming signal in order to avoid nuisance shut down occurrences at low current level settings. The offset thus introduced adversely affected the accuracy of the apparatus response over a significant range of operation.

There is a need for an improved user programmable adaptive current shutdown method and apparatus for use with power supply apparatuses. Such a method and apparatus is especially needed in connection with DC-to-DC power converters at low output current levels.

SUMMARY OF THE INVENTION

An apparatus for establishing an operating parameter, such as a shutdown circumstance, for a power supply device having an output. The apparatus comprises: (a) a first signal source; (b) a second signal source; (c) a third signal source; and (d) a state device. The first signal source is controllable for selectively generating a programming signal. The second signal source generates a load indicating signal and is connected with the power supply device. The third signal source generates an offset signal. The state device has a first input and a second input and changes state when the first input has a predetermined relationship with the second input. The first input is determined by relative values of the programming signal and the offset signal. The offset signal may be a constant value or it may be related with the output of the power supply device. The power supply device shuts down when the state device changes state in a predetermined manner.

The method of the present invention comprises the steps of: (a) providing, in no particular order, the following signals: (1) a programming signal appropriate for the shutdown circumstance; and (2) an offset signal; (b) applying a signal representative of the output to a first input of a state device; (c) substantially simultaneously with step (b), applying one of the following signals to a second input of the state device: (1) the programming signal; or (2) a combination of the programming signal and the offset signal; and (d) changing state of the state device when the first input has a predetermined relationship with the second input. The shutdown circumstance is effected when the state changes in a predetermined manner.

The invention is particularly suited for user-programming of output current limits for DC-to-DC power converter devices. Present such programming capabilities employing prior art apparatuses and methods introduce programming errors because a fixed offset voltage is imposed upon programming voltages in order to avoid a situation where the power converter device is "locked out" and cannot turn on.

It would be useful to have an apparatus and method for programming DC-to-DC power converter shutdown current parameter levels in a manner that diminishes programming errors and still avoids placing a power converter device in a "lock out" state where it is unable to turn on.

It is, therefore, an object of the present invention to provide an apparatus and method for programming a DC-to-DC power converter's shutdown current with diminished programming errors as compared with prior art apparatuses and methods.

It is a fuirther object of the present invention to provide an apparatus and method for programming a DC-to-DC power converter's shutdown current without placing the power converter in a "lock out" state, unable to turn on.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

Figure 1:
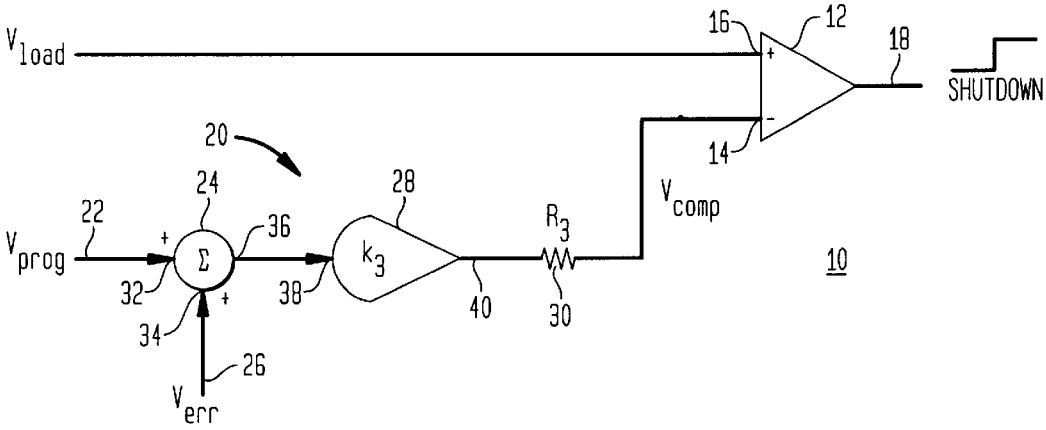
FIG. 1 (PRIOR ART)
FIG. 1 is an electrical schematic diagram of a prior art apparatus for current level shutdown programming.

FIG. 1 is an electrical schematic diagram of a prior art apparatus for current level shutdown programming. In FIG. 1, a shutdown programming apparatus 10 includes a state device 12 with a first input 14 and a second input 16. An output 18 of state device 12 changes state, as indicated by the waveform "SHUTDOWN" in FIG. 1, whenever signals appearing at first input 14 have a predetermined relationship with signals appearing at second input 16. For example, when state device 12 is embodied in a comparator-type device, output 18 will change state from a low state to a high state when value of a signal appearing at first input 14 is less than value of a signal appearing at second input 16. Output 18 is connected with a host device, not shown in FIG. 1, such as a power converter in a manner that configures the host device to alter its operation when state device 12 changes state in a particular manner, for example from a low state to a high state. For example, the host device may be connected with output 18 to cause the host device to shut down when state device 12 changes state in a particular manner. It is such an arrangement that is contemplated as the preferred embodiment of the present invention: an apparatus (e.g., apparatus 10) connected with a power supply device in a manner to cause the power supply device to shut down when state device 12 changes state in a particular manner.

In prior art apparatus 10, a signal representative of the load of the host device is applied to second input 16, such as voltage $V_{load}$, which is proportional to the load current $I_{load}$. First input 14 receives a signal from a programming circuit 20. Programming circuit 20 includes a programming signal source 22, a summing node 24, an error signal source 26, an amplifying unit 28, and a load 30.

Programming signal source 22 may be configured as a ladder-type circuit from which an operator may select a programming signal, such as programming signal $V_{prog}$, from among a plurality of discrete choices of programming signal level. The choice of which level of programming signal $V_{prog}$ to employ may also be effected using other circuit or software arrangements. The chosen level of programming signal $V_{prog}$ is determinative of the parameter value of a selected parameter associated with the host device (not shown in FIG. 1) when the host device shuts down. For example, choosing a particular value of programming signal $V_{prog}$ may determine the value of current provided at the load of the host device at the point at which the host device shuts down; the shutdown current of the power supply. Programming signal $V_{prog}$ is applied to an additive input 32 of summing node 24. Apparatus 10 and its associated host device (not shown in FIG. 1) are preferably arranged so that:

$$V_{load}\ I_{load} \quad [1]$$

$$V_{prog}\ I_{prog} \quad [2]$$

That is, load voltage $V_{load}$ is proportional to $I_{load}$ (current through the load of the host device), and programming signal $V_{prog}$ is proportional to $I_{prog}$ (current through programming circuit 20). Moreover, it is preferable that programming current signal $I_{prog}$ be related to load current $I_{load}$ in order that programming signal $V_{prog}$ (and, hence according to expression [2], programming current signal $I_{prog}$) be useful in reliably establishing shutdown current in the host device.

An error signal, such as error signal $V_{err}$ is applied from error signal source 26 to a subtractive input 34 of summing node 24. Error signal $V_{err}$ is intended as an offset value to ensure that the response of the host device does not approach a "lock-out" condition where the host device cannot turn on. Such a "lock-out" condition would exist, for example when programming signal $V_{prog}$ is set so low that state device 12 will never be in a state allowing the host device to turn on at any acceptable level of load current ($I_{load}$). Stated another way, as a practical matter, there is a design lower limit for load current designed into the host device, and a lock-out condition exists whenever programming signal $V_{prog}$ sets shut down current levels below that design lower limit for load current.

An output 36 carries a signal which is substantially equal to ($V_{prog}+V_{err}$), and that signal is applied to an input 38 of amplifying unit 28. If, by way of example, amplifying unit 28 has a gain of k3, then a signal produced at an output 40 of amplifying unit 28 will have substantially the value $k_3$ ($V_{prog}+V_{err}$). That signal is represented as a signal $V_{Comp}$ in FIG. 1. Therefore, to summarize, in FIG. 1:

$$V_{comp}=k_3\ (V_{prog}+V_{err}) \quad [3]$$

Since $V_{err}$ is a constant value signal, expression [3] may be rewritten to reflect the constant value of ($k_3 \cdot V_{err}$):

$$V_{comp}=k_3 \cdot I_{prog}+k_4 \quad [4]$$

where $k_4$ is a constant

The introduction of constant value error signal $V_{err}$ introduces an unacceptable degree of error in correlating programming current $I_{prog}$ with shutdown current for the host device. It is this correlating error that is obviated by the present invention.

Figure 2:
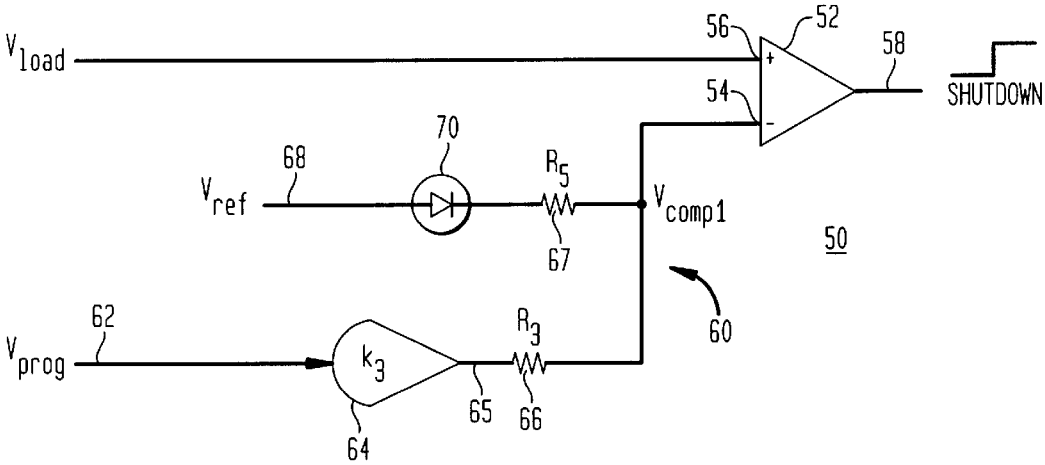
FIG. 2 (PRIOR ART)
FIG. 2 is an electrical schematic diagram of a first embodiment of an apparatus for current level shutdown programming according to the present invention.

FIG. 2 is an electrical schematic diagram of a first embodiment of an apparatus for current level shutdown programming according to the present invention. In FIG. 2, a shutdown programming apparatus 50 includes a state device 52 with a first input 54 and a second input 56. An output 58 of state device 52 changes state, as indicated by the waveform "SHUTDOWN" in FIG. 2, whenever signals appearing at first input 54 have a predetermined relationship with signals appearing at second input 56. For example, when state device 52 is embodied in a comparator-type device, output 58 will change state from a low state to a high state when value of a signal appearing at first input 54 is less than value of a signal appearing at second input 56. Output 58 is connected with a host device, not shown in FIG. 2, such as a power converter in a manner that configures the host device to alter its operation when state device 52 changes state in a manner substantially the same as a host device responds to state changes effected by apparatus 10 (FIG. 1). In order to avoid prolixity, the relationship between host device and the apparatus of the present invention for programming shutdown current in the host device will not be repeated here.

In apparatus 50, a signal representative of the load of the host device is applied to second input 56, such as load voltage $V_{load}$. First input 54 receives a signal from a programming circuit 60. Programming circuit 60 includes a programming signal source 62, an amplifying unit 64, a load 66, a reference signal source 68, and a circuit control device 70.

Programming signal source 62 may be configured in a manner similar to programming signal source 22 (FIG. 1). The chosen level of programming signal $V_{prog}$ is determinative of a selected parameter associated with the host device (not shown in FIG. 2) when the host device shuts down, such as shutdown current at the load of the host device. Programming signal $V_{prog}$ is applied to amplifying unit 64. Apparatus 50 and its associated host device (not shown in FIG. 2) are preferably arranged so that expressions [1] and [2] are valid:

$$V_{load}\ I_{load} \quad [1]$$

$$V_{prog}\ I_{prog} \quad [2]$$

A reference signal, such as reference signal $V_{ref}$ is applied from reference signal source 68 to circuit control device 70. Reference signal $V_{ref}$ is intended as an offset value to ensure that the response of the host device does not approach a lock-out condition. Circuit control device 70 may preferably be embodied in a diode, as indicated in FIG. 2.

If, by way of example, amplifying unit 64 has a gain of $k_3$, then a signal produced at an output 65 of amplifying unit 64 will have substantially the value ($k_3 \cdot V_{prog}$), and is applied to first input 54 via a resistor 66 having a value of $R_3$. Circuit control device 70 operates to apply reference voltage $V_{ref}$ to first input 54 via a resistor 67 when signal ($k_5 \cdot V_{ref}$) is greater than signal ($k_3 \cdot V_{prog}$). Resistor 67 has a value of $R_5$. Constant value $k_5$ is defined below in expression [6]. As a result, a voltage $V_{comp1}$ is applied to first input 54 which is a combination of derivatives of reference signal $V_{ref}$ and programming signal $V_{prog}$ in the following proportions:

$$V_{comp1} = V_{ref}\frac{R_3}{R_3 + R_5} + (k_3 \cdot V_{prog})\frac{R_5}{R_3 + R_5} \quad [5]$$

$$k_4 \cdot V_{comp1} = k_5 \cdot V_{ref} + (k_3 \cdot V_{prog}) \quad [6]$$

$$\text{where, } k_4 = \frac{R_3 + R_5}{R_5}$$

$$k_5 = \frac{R_3}{R_5}$$

If resistor 67 is shorted, then value $R_5$=0 and the result is that voltage $V_{comp1}$=$V_{ref}$.

Otherwise, when signal ($k_5 \cdot V_{ref}$) is less than signal ($k_3 \cdot V_{prog}$), voltage $V_{comp1}$ applied to first input 54 of state device 52 equals signal ($k_3 \cdot V_{prog}$). For purposes of illustration, all of these various signal relationships assume control device 70 operates as an ideal diode.

Thus, reference voltage $V_{ref}$ is not always involved in signal $V_{comp1}$ applied by programming circuit 60 to first input 54 of state device 52. The offset provided by reference voltage $V_{ref}$ is only involved in operation of apparatus 50 when the programming signal $V_{prog}$ is sufficiently small to cause the value ($k_3 \cdot V_{prog}$ to be less than the value ($k_5 \cdot V_{ref}$). This selective involvement of an offset provided by reference voltage $V_{ref}$ significantly reduces introduction of programming error throughout the operating range of the host device associated with apparatus 50; the selective application of reference voltage $V_{ref}$ to operating ranges of apparatus 50 having low levels of programming signal $V_{prog}$ provides protection from placing apparatus 50 in a "lock-out" condition while avoiding introduction of unnecessary programming errors in the remainder of the operating range of the host device associated with apparatus 50.

Therefore, to summarize, in FIG. 2:

$$V_{comp1} \propto k_5 \cdot V_{ref} + (k_3 \cdot V_{prog}) \quad [7]$$

$$\text{when } k_5 \cdot V_{ref} > (k_3 \cdot V_{prog});\ k_5 = \frac{R_3}{R_5}$$

$$V_{comp1} = (k_3 \cdot V_{prog}) \quad [8]$$

$$\text{when } (k_3 \cdot V_{prog}) > k_5 \cdot V_{ref}$$

That is, offset provided by imposing reference voltage $V_{ref}$ into signal $V_{comp1}$ only at low values of programming signal $V_{prog}$ provides a close correlation (i.e., with reduced error) between programming current $I_{prog}$ and shutdown current in values of programming signal $V_{prog}$ greater than reference voltage $V_{ref}$.

Figure 3:
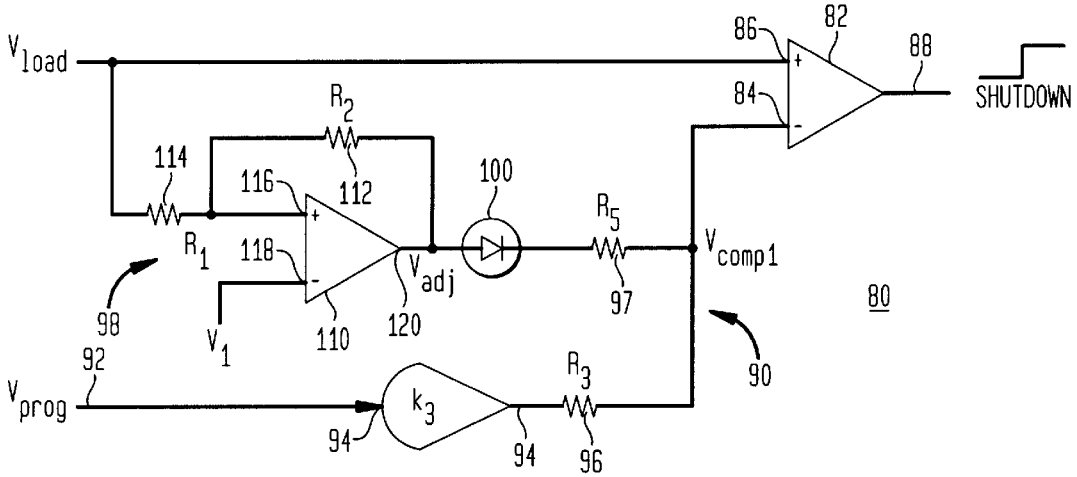
FIG. 3 is an electrical schematic diagram of a second embodiment of an apparatus for current level shutdown programming according to the present invention.

FIG. 3 is an electrical schematic diagram of a second embodiment of an apparatus for current level shutdown programming according to the present invention. In FIG. 3, a shutdown programming apparatus 80 includes a state device 82 with a first input 84 and a second input 86. An output 88 of state device 82 changes state, as indicated by the waveform "SHUTDOWN" in FIG. 3, whenever signals appearing at first input 84 have a predetermined relationship with signals appearing at second input 86. In apparatus 80, a signal representative of the load of the host device is applied to second input 86, such as load voltage $V_{load}$. First input 84 receives a signal from a programming circuit 90. Programming circuit 90 includes a programming signal source 92, an amplifying unit 94, a load 96, an adjustment signal source 98, and a circuit control device 100.

Comparison of the embodiments of the present invention illustrated in FIGS. 2 and 3 reveals that the differences between the embodiments substantially arise in the configurations of programming circuit 60 (FIG. 2) and programming circuit 90 (FIG. 3). In order to avoid prolixity, portions of apparatus 80 which are substantially similar in configuration and operation to apparatus 50 (FIG. 2) will not be repeated here.

Apparatus 80 and an associated host device (not shown in FIG. 3) are preferably arranged so that expressions [1] and [2] are valid:

$$V_{load}\, I_{load} \quad [1]$$

$$V_{prog}\, I_{prog} \quad [2]$$

An adjustment signal such as adjustment signal $V_{adj}$ is applied from adjustment signal source 98 to circuit control device 100. Adjustment signal source 98 includes an amplifier device 110 with a feedback resistor 112 and an input bias resistor 114. Input bias resistor 114 is connected to convey load voltage $V_{load}$ to a noninverting input 116 of amplifier device 110. A voltage $V_1$ is applied to an inverting input 118 of amplifier device 110. An output 120 of amplifier device 110 conveys adjustment signal $V_{adj}$ to circuit control device 100. Adjustment signal $V_{adj}$ is intended as an offset value to ensure that the response of the host device does not approach a lock-out condition. Circuit control device 100 may be preferably embodied in a diode, as indicated in FIG. 3.

If, by way of example, amplifying unit 94 has a gain of $k_3$, then a signal produced at an output 95 of amplifying unit 94 will have substantially the value ($k_3 \cdot V_{prog}$), and is applied to first input 84 via a resistor 96 having a value of $R_3$. Circuit control device 100 operates to apply an adjustment signal $V_{adj}$ to first input 84 via a resistor 97 when signal ($k_5 \cdot V_{adj}$) is greater than signal ($k_3 \cdot V_{prog}$). Resistor 97 has a value of $R_5$. Constant value $k_5$ is defined below in expression [9]. As a result, a voltage $V_{comp2}$ is applied to first input 84 which is a combination of derivatives of reference signal $V_{adj}$ and programming signal $V_{prog}$ in the following proportions:

$$V_{comp2} = V_{adj}\frac{R_3}{R_3 + R_5} + (k_3 \cdot V_{prog})\frac{R_5}{R_3 + R_5} \quad [9]$$

$$k_4 \cdot V_{comp2} = k_5 \cdot V_{adj} + (k_3 \cdot V_{prog})$$

$$\text{where, } k_4 = \frac{R_3 + R_5}{R_5}$$

$$k_5 = \frac{R_3}{R_5}$$

If resistor 97 is shorted, then value $R_5$=0 and the result is that voltage $V_{comp2}$=$V_{adj}$.

Otherwise, when signal ($k_5 \cdot V_{adj}$) is less than signal ($k_3 \cdot V_{prog}$), voltage $V_{comp2}$ applied to first input 84 of state device 82 equals signal ($k_3 \cdot V_{prog}$). For purposes of illustration, all of these various signal relatoinships assume control device 100 operates as an ideal diode.

Thus, adjustment signal $V_{adj}$ is not always involved in the signal applied by programming circuit 80 to first input 84 of state device 82. The offset provided by adjustment signal $V_{adj}$ is only involved in operation of apparatus 80 when the programming voltage signal $V_{prog}$ is sufficiently small to cause the value $(k_3 \cdot V_{prog})$ to be less than the value $(k_5 \cdot V_{adj})$. This selective involvement of offset signal $V_{adj}$ avoids introduction of programming error throughout the operating range of apparatus 80 in a manner similar to the operation of apparatus 50 (FIG. 2). By deriving adjustment signal $V_{adj}$ from load voltage $V_{load}$ the offset provided by adjustment signal $V_{adj}$ for operation of apparatus 80 is more dynamically responsive to the host device associated with apparatus 80 than was the case involving apparatus 50 (FIG. 2). It is because of the added dynamic response of the embodiment of the present invention illustrated in FIG. 3 that the embodiment of FIG. 3 is regarded as the preferred embodiment of the present invention.

To summarize, in FIG. 3:

$$V_{comp2} \propto k_5 \cdot V_{adj} + (k_3 \cdot V_{prog}) \quad [11]$$

$$\text{when } k_5 \cdot V_{adj} > (k_3 \cdot V_{prog});\ k_5 = \frac{R_3}{R_5}$$

$$V_{comp2} = (k_3 \cdot V_{prog}) \quad [12]$$

$$\text{when } (k_3 \cdot V_{prod} > k_5 \cdot V_{adj}$$

When resistor 112 has a value of $R_1$, and resistor 114 has a value of $R_2$, then it may be concluded that:

$$V_{adj} = V_1\left(1 + \frac{R_2}{R_1}\right) - V_{load}\left(\frac{R_2}{R_1}\right) \quad [13]$$

Noting that $V_1$, $R_1$ and $R_2$ are each constant values, expression [13] may be reduced to:

$$V_{adj} = k_1 - k_2 \cdot V_{load} \quad [14]$$

$$\text{where, } k_1 = V_1\left(1 + \frac{R_2}{R_1}\right)$$

$$k_2 = \left(\frac{R_2}{R_1}\right)$$

Figure 4:
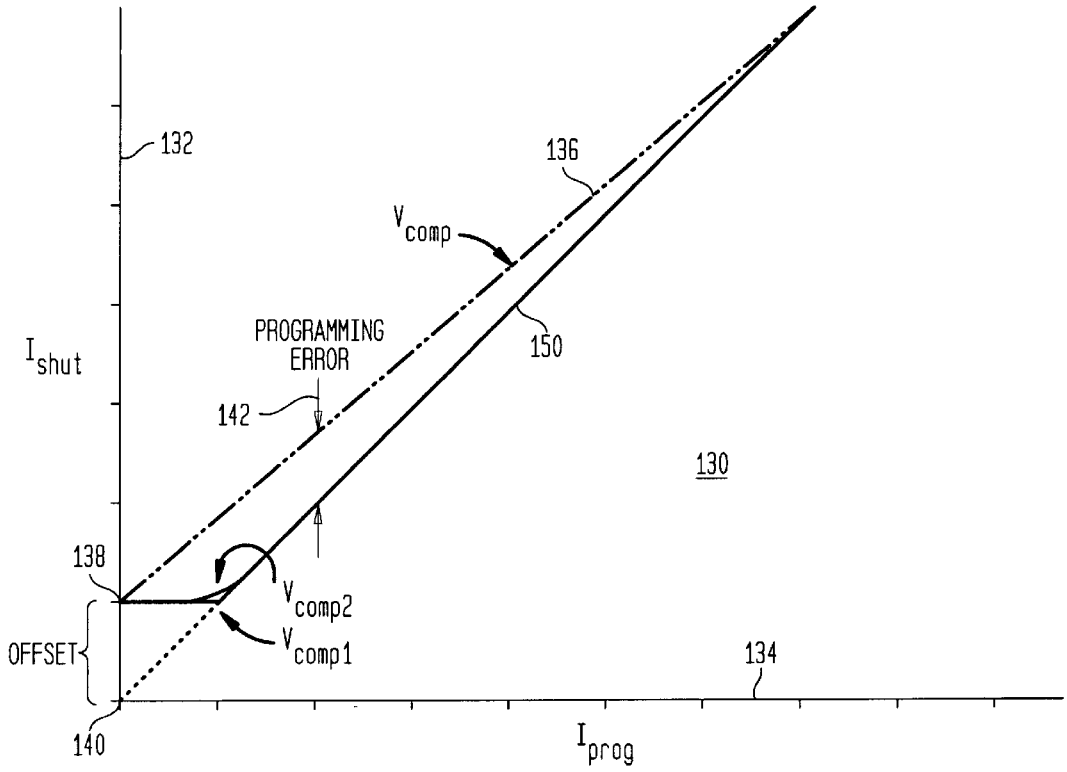
FIG. 4 is a graphic representation of the relationship between programming current and shutdown current for prior art apparatuses and for the apparatus of the present invention.

FIG. 4 is a graphic representation of the relationship between programming current and shutdown current for prior art apparatuses and for the apparatus of the present invention. In FIG. 4, a graphic plot 130 displays shutdown current ($I_{shut}$) for a host device appropriate for use with the present invention plotted vis-à-vis a vertical axis 132. Shutdown current $I_{shut}$ is a function of programming current ($I_{prog}$), plotted vis-à-vis a horizontal axis 134. A dotted-line plot 136 extends generally linearly from a minimum intercept 138 on axis 132. The distance from minimum intercept 132 to the origin 140 of plot 130 is the offset provided by prior art and present invention apparatuses to avoid putting host devices in a "lock-out" condition. That is, design minimum shutdown current $I_{shut}$ for the host device used with the apparatus of the present invention is set at a value between origin 140 and minimum intercept 138 on axis 132.

If a host device is allowed to approach or reach origin 140, the programmed shutdown current $I_{shut}$ will be below the design minimum shutdown current; in such a condition the host device will not be able to turn on. This "lock-out" condition is known to those skilled in the art. As a generally accepted engineering good practice, a margin is provided to ensure that design minimum shutdown current is not approached, thereby obviating any risk of a "lock-out" condition in a host device.

An unfortunate consequence of the constant offset provided by the prior art apparatus (FIG. 1) is that the departure point of plot 136 ($V_{comp}$, FIG. 1) is offset from origin 140 and the slope of plot 136 is thereby affected. The change in slope introduces programming errors (representatively indicated in FIG. 4 at 142).

The present invention, in both disclosed embodiments illustrated herein (FIGS. 1 and 2) provide a departure point for a plot from origin 140, yet avoid approaching origin 140. This is accomplished because the offset between origin 140 and minimum intercept 138 on axis 132 is only introduced at low programming currents $I_{prog}$. Thus, programming errors are avoided except where desired: to ensure there is not too close an approach to a "lock-out" condition near origin 140. The constant offset value introduced at low programming current $I_{prog}$, illustrated in FIG. 2, is indicated as an intersection of two linear plots, and identified as $V_{comp1}$ in FIG. 4. That is, the value $V_{ref}$ is additively imposed upon programming signal $V_{prog}$ at low values of programming signal $V_{prog}$ to establish a minimum value of shutdown current $I_{shut}$ at minimum intercept 138 for low values of programming current $I_{prog}$. When programming signal $V_{prog}$ equals or exceeds reference voltage $V_{ref}$, then the response of shut down current conforms to a plot that originates at origin 140. In such manner, programming errors are substantially eliminated.

Figure 5:
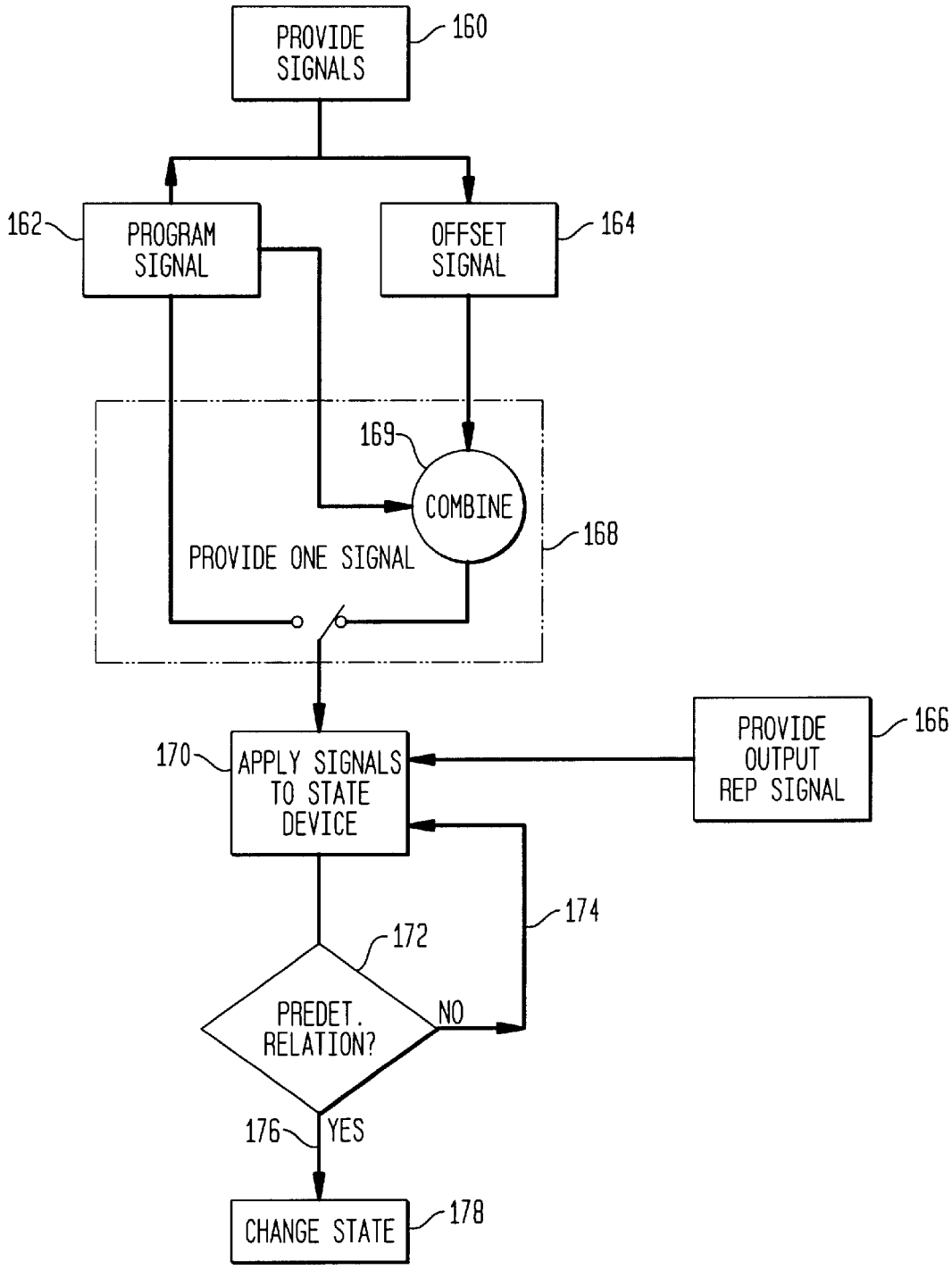
FIG. 5 is a flow chart illustrating the method of the present invention.

FIG. 5 is a flow chart illustrating the method of the present invention. In FIG. 5, the method begins with providing two signals in no particular order, as indicated by a block 160. The two signals provided according to block 160 are a programming signal, as indicated by a block 162, and an offset signal, as indicated by a block 164. A signal representative of the output of a host device associated with the practice of the method of the present invention is provided according to a block 166. According to a block 168, one of the programming signal sand a combination of the programming signal and the offset signal (combined as indicated by a block 169) is provided. The provision of signals according to blocks 166 and 168 preferably occurs substantially simultaneously.

Signals provided according to blocks 166, 168 are applied to a state device, as indicated by a block 170. A query is posed: "Is there a predetermined relation between the signals applied to the state device according to lock 170?", according to a block 172. If the predetermined relation does not exist between the signals applied to the state device, the process proceeds according to "NO" response path 174 and later-in-time samples of the selected signals and applied to the state device, according to block 170. If the predetermined relation does exist, the process proceeds according to "YES" response path 176, and the state device changes state, as indicated by a block 178. When the state change occurs according to a predetermined manner, the host device, such as a power supply device, shuts down. This last step of shutting down is not reflected in FIG. 5.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

I claim:

1. An apparatus for establishing an operating parameter for a power supply device said power supply device having an output; the apparatus comprising:

(a) a first signal source, said first signal source generating a first signal, (b) a second signal source, said second signal source generating a second signal; said second signal source being connected with said power supply device;

(c) a third signal source, said third signal source generating a third signal; and (d) a state device;

said state device having a plurality of inputs, said state device changing state when a first input of said plurality of inputs has a predetermined relationship with a second input of said plurality of inputs; said first signal being adjustable selected by a user, said first input being determined by relative values of said first signal and said third signal; said second input being determined by said second signal, said third signal being combined with said first signal when said first signal is substantially equal to or exceeds said third signal.

2. An apparatus for establishing an operating parameter for a power supply device as recited in claim 4 wherein said third signal is a constant signal.

3. An apparatus for establishing an operating parameter for a power supply device as recited in claim 4 wherein said third signal is derived from said output.

4. An apparatus for establishing a shutdown circumstance for a power supply device; said power supply device having an output; the apparatus comprising:

(a) a first signal source, said first signal source being controllable for selectively generating a programming signal;

(b) a second signal source; said second signal source generating a load indicating signal; said second signal source being connected with said power supply device;

(c) a third signal source, said third signal source generating an offset signal; and (d) a state device;

said state device having a first input and a second input: said state device changing state when said first input has a predetermined relationship with said second input; said first input being determined by relative values of said programming signal and said offset signal; said second input being determined by said load indicating signal: said power supply device shutting down when said state device changes state in a predetermined manner; said offset signal being combined with said programming signal when said programming signal is substantially equal to or exceeds said offset signal.

5. An apparatus for establishing a shutdown circumstance for a power supply device as recited in claim 4 wherein said offset signal is a constant signal.

6. An apparatus for establishing a shutdown circumstance for a power supply device as recited in claim 4 wherein said offset signal is derived from said output.

7. A method for establishing a shutdown circumstance for a power supply device; the method comprising the steps of:

(a) providing, in no particular order, the following signals:
(1) a programming signal appropriate for said shutdown circumstance; and
(2) an offset signal;

(b) applying a signal representative of said output to a first input of a state device;

(c) substantially simultaneously with step (b), applying one of the following signals to a second input of said state device:
(1) said programming signal; or
(2) a combination of said programming signal and said offset signal, and (d) changing state of said state device when said first input has a predetermined relationship with said second input; said shutdown circumstance being effected when said state changes in a predetermined manner, said offset signal being combined with said programming signal when said programming signal is substantially equal to or exceeds said offset signal.

8. A method for establishing a shutdown circumstance for a power supply device as recited in claim 7 wherein said offset signal is a constant signal.

9. A method for establishing a shutdown circumstance for a power supply device as recited in claim 7 wherein said offset signal is derived from said output.

* * * * *